US010533292B2

(12) United States Patent
Parkes et al.

(10) Patent No.: US 10,533,292 B2
(45) Date of Patent: Jan. 14, 2020

(54) LOAD TRANSFER PLATE AND METHOD OF EMPLOYING SAME

(71) Applicant: Illinois Tool Works Inc., Glenview, IL (US)

(72) Inventors: Nigel K. Parkes, Atlanta, GA (US); Robert U. Connell, Melbourne (AU)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 15/833,589

(22) Filed: Dec. 6, 2017

(65) Prior Publication Data

US 2018/0171629 A1 Jun. 21, 2018

Related U.S. Application Data

(60) Provisional application No. 62/436,789, filed on Dec. 20, 2016.

(51) Int. Cl.

| | |
|---|---|
| ***E01C 19/50*** | (2006.01) |
| ***E04B 5/32*** | (2006.01) |
| ***E04B 1/04*** | (2006.01) |

(52) U.S. Cl.

CPC ..... *E01C 19/504* (2013.01); *E04B 1/043* (2013.01); *E04B 5/32* (2013.01)

(58) Field of Classification Search

CPC ..... E01C 11/14; E01C 19/504; E01C 23/045; E01C 23/04; E04G 17/06; E04B 1/48; E04B 1/483; E04B 5/32; E04B 2103/02; E04B 1/043; E04B 1/21; E04F 15/14; F16B 13/141

See application file for complete search history.

(56) References Cited

U.S. PATENT DOCUMENTS

| | | | |
|---|---|---|---|
| 2,094,853 | A | 10/1937 | Shaw |
| 2,181,005 | A | 11/1939 | Westcott |
| 2,316,233 | A | 4/1943 | Fischer |
| 2,349,983 | A | 5/1944 | Musall |
| 2,654,297 | A | 10/1953 | Nettleton |
| 3,559,541 | A | 2/1971 | Watstein |
| 4,733,513 | A | 3/1988 | Schrader et al. |

(Continued)

FOREIGN PATENT DOCUMENTS

| | | | |
|---|---|---|---|
| CA | 2712305 A1 * | 7/2009 | ..... E01C 11/14 |
| DE | 102007020816 B3 * | 10/2008 | ..... E01C 11/08 |

(Continued)

OTHER PUBLICATIONS

International Search Report and Written Opinion for International Application No. PCT/US2017/065028, dated May 25, 2018 (18 pages).

(Continued)

*Primary Examiner* — Jessie T Fonseca

(74) *Attorney, Agent, or Firm* — Neal, Gerber & Eisenberg LLP

(57) ABSTRACT

Various embodiments of the present disclosure provide a load transfer plate including a non-symmetrically shaped body having a semi-cylindrical first portion configured to protrude into and be secured in the first cast-in-place concrete slab and a non-semi cylindrical second portion configured to protrude into a load transfer plate pocket secured in the second cast-in-place concrete.

6 Claims, 16 Drawing Sheets

(56) References Cited

U.S. PATENT DOCUMENTS

| | | | | |
|---|---|---|---|---|
| 4,942,912 | A | 7/1990 | Gakhar et al. | |
| 5,458,433 | A | 10/1995 | Stastny | |
| 5,730,544 | A | 3/1998 | Dils et al. | |
| 6,019,546 | A | 2/2000 | Ruiz | |
| 6,145,262 | A | 11/2000 | Schrader et al. | |
| 6,354,760 | B1 * | 3/2002 | Boxall | E01C 11/14 404/47 |
| 6,775,952 | B2 | 8/2004 | Boxall et al. | |
| 6,926,463 | B2 | 8/2005 | Shaw et al. | |
| 7,228,666 | B2 | 6/2007 | Michiels | |
| 7,338,230 | B2 | 3/2008 | Shaw et al. | |
| 7,481,031 | B2 | 1/2009 | Boxall et al. | |
| 7,604,432 | B2 | 10/2009 | Shaw et al. | |
| 7,637,689 | B2 | 12/2009 | Boxall et al. | |
| 7,716,890 | B2 | 5/2010 | Boxall et al. | |
| 7,736,088 | B2 | 6/2010 | Boxall et al. | |
| 8,302,359 | B2 | 11/2012 | Boxall et al. | |
| 8,303,210 | B2 | 11/2012 | Parkes et al. | |
| 8,356,955 | B2 | 1/2013 | Nadler | |
| 8,381,470 | B2 | 2/2013 | Boxall et al. | |
| 8,573,884 | B2 | 11/2013 | Nadler | |
| 8,627,626 | B2 | 1/2014 | Boxall et al. | |
| 2006/0140721 | A1 * | 6/2006 | Shaw | E01C 11/14 404/60 |
| 2006/0275078 | A1 | 12/2006 | Shaw et al. | |
| 2007/0269266 | A1 | 11/2007 | Kelly et al. | |
| 2010/0054858 | A1 | 3/2010 | Mayo et al. | |
| 2015/0204026 | A1 * | 7/2015 | McDonald | E01C 11/14 404/60 |

FOREIGN PATENT DOCUMENTS

| | | | | |
|---|---|---|---|---|
| FR | 3043105 | A1 * | 5/2017 | E01C 11/14 |
| GB | 2 285 641 | | 7/1995 | |
| WO | WO 2004/065694 | | 8/2004 | |
| WO | WO-2005111332 | A2 * | 11/2005 | E01C 11/14 |
| WO | WO 2006/123176 | | 11/2006 | |

OTHER PUBLICATIONS

Diamond Dowel® System Tapered Plate Dowels for Formed Construction Joints brochure, by PNA Construction Technologies, available Jan. 2010 (2 pages).

Diamond™ Dowel Load Transfer System Industrial Slab on Ground brochure, by Danley™ Systems, available Sep. 2016 (8 pages).

Load Transfer Systems Dowel Cradles Industrial Slab on Ground brochure, by ITW Construction Systems and Danley Systems, available prior to Nov. 16, 2016 (12 pages).

* cited by examiner

LOAD TRANSFER PLATE AND METHOD OF EMPLOYING SAME

PRIORITY

This application claims priority to and the benefit of U.S. Provisional Patent Application Ser. No. 62/436,789, filed Dec. 20, 2016, the entire contents of which are incorporated herein by reference.

BACKGROUND

For various logistical and technical reasons, concrete floors are typically made up of a series of individual cast-in-place concrete blocks or slabs referred to herein as "concrete slabs" or "slabs". These concrete slabs provide several advantages including relief of internal stress due to curing shrinkage and thermal movement. However, there are various known issues with such concrete slabs.

One issue with concrete floors occurs when one of the concrete slabs is damaged and needs to be replaced with a new concrete slab. The damaged concrete slab must be removed, and a new concrete slab must be poured and hardened or cured to properly restore the concrete floor adjacent to the remaining existing concrete slab.

Another issue with concrete floors occurs when part of one of the concrete slabs is damaged and needs to be replaced. In such case, a vertically extending cut is made in the concrete slab to separate the damaged part of the concrete slab from the non-damaged part of the concrete slab. The damaged part of the concrete slab is then removed. A new portion of that concrete slab is poured and hardened or cured to properly restore the concrete slab adjacent to the remaining existing, undamaged part of the concrete slab.

In both of these situations, the new concrete slab is positioned adjacent to one or more other existing concrete slabs or preserved non-damaged portion of an existing concrete slab. For purposes of this disclosure, a preserved non-damaged portion of an existing concrete slab will simply be referred to as an existing concrete slab or a first concrete slab. Furthermore, the newly poured concrete slab will simply be referred to as a new concrete slab or a second concrete slab.

Thus, in both of these situations, a joint will be created between the existing concrete slab and the new concrete slab, Since a joint is created, various known issues involving joints between adjacent concrete slabs (i.e., the interface where one concrete slab meets another concrete slab) need to be considered and addressed.

One known issue with such joints involves the relative vertical movements of the adjacent existing and new concrete slabs relative to each other. The adjacent concrete slabs are preferably configured to move individually, and are also preferably configured with load transferring devices to transfer vertical loads from one concrete slab to the adjacent concrete slab. Transferring vertical loads between adjacent concrete slabs has been accomplished using various different load transferring devices and methods. Various load transferring devices for adjacent concrete slabs are described in U.S. Pat. No. 6,354,760.

U.S. Pat. No. 8,356,955 describes load transferring devices for use between an existing concrete slab and a new concrete slab. U.S. Pat. No. 8,356,955 and FIG. 1 of the present application generally illustrate a known cutting tool 10 cutting a cutaway 70 into a side edge 92 of an existing concrete slab 90. The shape of the cutaway 70 is semi-cylindrical due to the circular saw blade used to cut the cutaway 70.

U.S. Pat. No. 8,356,955 and FIG. 2 of the present application generally illustrate a known somewhat football shaped dowel 20 that has been used or proposed to be used in such known existing concrete slabs. Specifically, one known method generally includes inserting a first portion of the known dowel 20 into the cutaway 70 after the cutaway 70 is formed in the existing concrete slab 90. This known method further includes attaching a known dowel receiving sheath 300 (such as one disclosed in U.S. Pat. No. 6,354,760) over the other portion of the known dowel 20 (i.e., the portion that does not protrude into the cutaway 70). The known method further includes pouring the concrete of the new concrete slab around the dowel receiving sheath 300 that is positioned on the dowel 20 and partially extends into the cutaway 70 of the existing concrete slab 90. When the new concrete cures, the dowel 20 is positioned to transfer loads between the existing concrete slab 90 and the adjacent new concrete slab.

However, one problem that exists with such known dowels 20 and such known dowel receiving sheaths 300 is that the portion of the known dowel 20 that is inserted into the known dowel receiving sheath 300 does not conform to the shape of the known dowel receiving sheath 300. This problem increases relative movement between the new and existing concrete slabs in a direction parallel and perpendicular to the longitudinal axis of the joint, and also reduces loadings per square inch in the new and existing concrete slabs close to the joint when transferring vertical or substantially vertical loads from the existing concrete slab to the adjacent, new concrete slab.

Accordingly, there is a need for improved load transfer devices and methods of using such improved load transfer devices that solve these problems.

SUMMARY

Various embodiments of the present disclosure provide a load transfer apparatus including a load transfer plate and method of employing the load transfer plate that solves the above problems.

Various embodiments of the present disclosure provide a load transfer apparatus including a non-symmetrical load transfer plate that is configured to transfer vertical or substantially vertical loads from one concrete slab to an adjacent concrete slab in an enhanced manner in part by optimizing interaction with the load transfer pocket. More specifically, various embodiments of the load transfer plate of the present disclosure include a generally non-symmetrically shaped body having: (a) a tapered generally semi-cylindrical first half or portion configured to extend into and be secured in the existing concrete slab; and (b) a tapered trapezoidal second half or portion configured to be positioned in the load transfer plate pocket at installation and move with respect to the load transfer plate pocket that is configured to be secured in the new concrete slab.

Various other embodiments of the load transfer plate of the present disclosure include a generally non-symmetrically shaped body having: (a) a tapered generally semi-cylindrical first half or portion configured to protrude into and be secured in the existing concrete slab; and (b) a tapered generally triangular second half or portion configured to be positioned in the load transfer plate pocket at installation and move with respect to the load transfer plate pocket that is configured to be secured in the new concrete slab.

In various example embodiments, the method of installing the load transfer plate of the present disclosure includes: (1) making a cutaway in a side edge of an existing concrete slab by using a cutting tool; (2) inserting the first portion of the load transfer plate in the cutaway of the side edge of the existing concrete slab; (3) inserting the second portion of the load transfer plate into a load transfer plate receiving opening of a load transfer plate pocket and further into the load transfer plate receiving chamber of the load transfer plate pocket such that the load transfer plate pocket and the load transfer plate protrude into an area to be occupied by a new concrete slab; (4) pouring the concrete material that forms the new cast-in-place concrete slab into the area to be occupied by the new concrete slab; and (5) allowing the new concrete slab to cure or harden.

Additional features and advantages of the present invention are described in, and will be apparent from, the following Detailed Description and the Figures.

DETAILED DESCRIPTION OF EXAMPLE EMBODIMENTS

Figure 1:
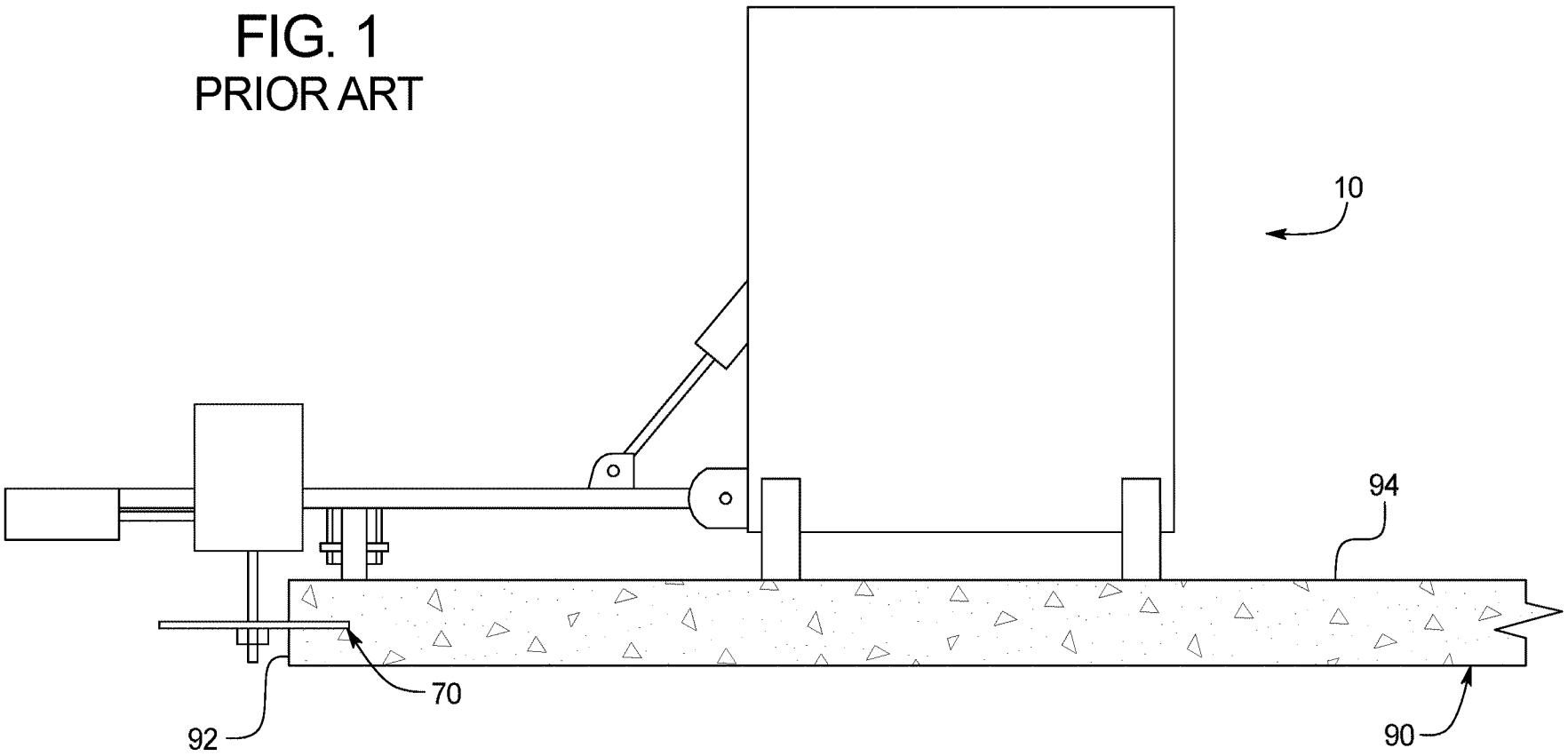
FIG. 1 PRIOR ART
FIG. 1 is a diagrammatic side perspective view of a known cutting tool used to cut a cutaway into the side edge of an existing concrete slab.
Figure 2:
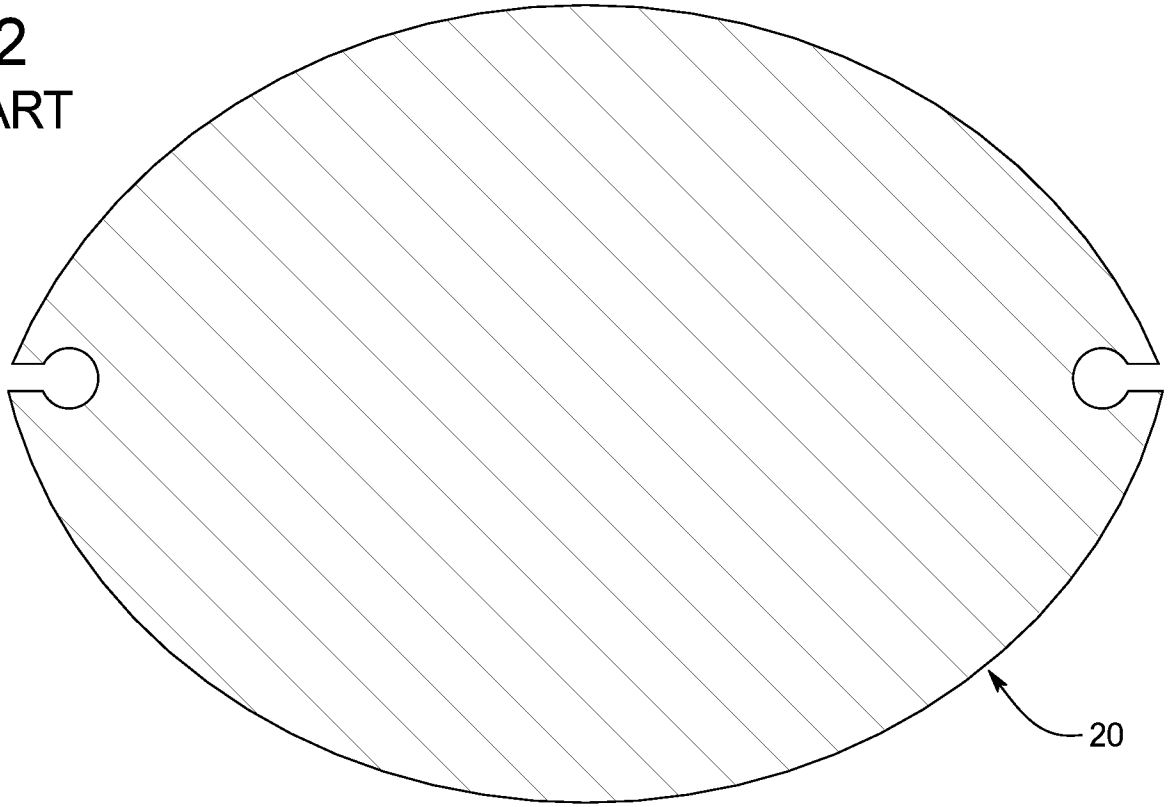
FIG. 2 PRIOR ART
FIG. 2 is a top perspective view of a known load transfer plate.
Figure 3:
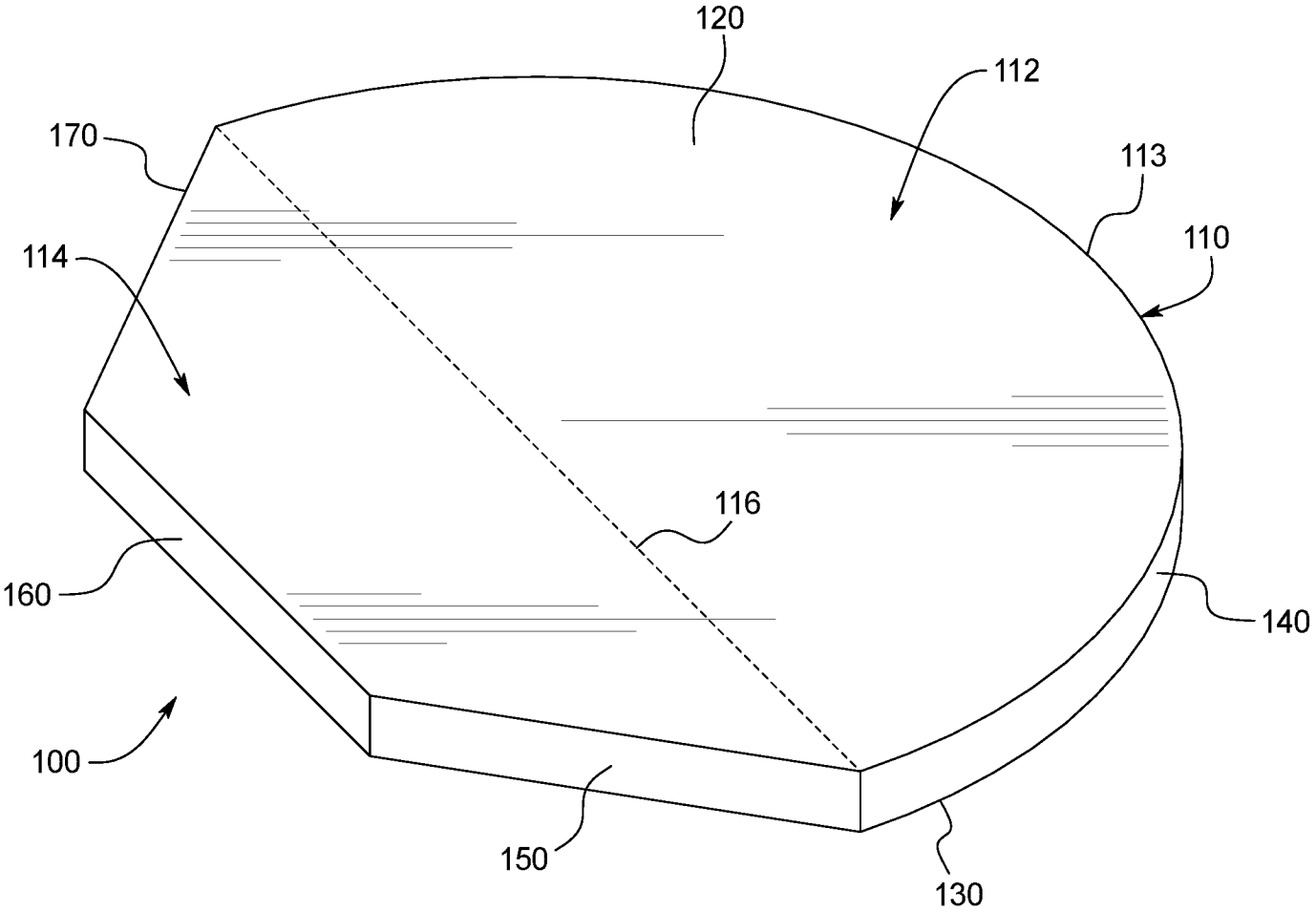
FIG. 3 is a top perspective view of the load transfer plate of one example embodiment of the present disclosure.

Various embodiments of the present disclosure provide an improved load transfer plate that is configured to work with a load transfer plate pocket and that solves the above problems. The load transfer plate is configured to transfer loads between an existing slab (such as a first or existing concrete slab) and a new adjacent slab (such as a second or new concrete slab).

Referring now to FIGS. 3, 4A, 4B, 5, 6, 7, 8, 9, 10, and 11, one example embodiment of the load transfer plate of the present disclosure is generally indicated by numeral 100. FIGS. 1, 5, 6, 7, 8, 9, 10, and 11 also generally partially illustrate one method of employing or installing the load transfer plate 100 of the present disclosure with a load transfer plate pocket 300 in an existing cast-in-place slab (such as existing concrete slab 90) and a new cast-in-place slab (such as new concrete slab 96). It should be appreciated that multiple spaced apart sets of load transfer plates 100 of the present disclosure and multiple load transfer plate pockets 300 can be employed in such adjacent existing and new concrete slabs to co-act to transfer vertical or substantially vertical loads from one concrete slab to the adjacent concrete slab in an enhanced manner in part by optimizing the positions of the load transfer plates 100 relative to the load transfer plate pockets 300 for load transfer between the adjacent existing and new concrete slabs.

In this illustrated example embodiment, the load transfer plate 100 includes a generally non-symmetrically shaped body 110 having: (a) a tapered, generally semi-cylindrical first half or portion 112 configured to protrude into a cutaway 70 made in a side edge 92 of the first concrete slab 90; and (b) a tapered, generally trapezoidal second half or portion 114 configured to be partially positioned in the load transfer plate pocket 300 at installation and also protrude into and be secured in the new concrete slab 96.

The body 110 of the load transfer plate 100 also generally includes: (a) a substantially planar upper surface 120; (b) a substantially planar lower surface 130; (c) a first outer edge 140; (d) a second outer edge 150; (e) a third outer edge 160; and (f) a fourth outer edge 170.

The first outer edge 140 extends perpendicular or substantially perpendicular to the upper surface 120 and to the lower surface 130 and is generally semi-cylindrical. The second outer edge 150 extends perpendicular or substantially perpendicular to the upper surface 120 and to the lower surface 130 and is generally straight. The third outer edge extends perpendicular or substantially perpendicular to the upper surface 120 and to the lower surface 130 and is generally straight. The fourth outer edge 170 extends perpendicular or substantially perpendicular to the upper surface 120 and to the lower surface 130 and is generally straight. It should be appreciated that the shape of these outer edges may vary in accordance with the present disclosure, such as discussed below.

In this illustrated example embodiment, the tapered first portion 112 has a largest width (measured parallel to the longitudinal axis of the joint) at the area of the first portion 112 adjacent to the tapered second portion 114, and a narrower width adjacent to the first outer edge 140. In this illustrated example embodiment, the first portion 112 is uniformly tapered from the area of the first portion 112 adjacent to second portion 114 to the point 113; however, such taper does not have to be uniform in accordance with the present disclosure.

In this illustrated example embodiment, the tapered second portion 114 has a largest width (measured parallel to the longitudinal axis of the joint) at the area of the second portion 114 adjacent to the tapered first portion 112, and a narrower width adjacent to the third outer edge 160. In this illustrated example embodiment, the second portion 114 is uniformly tapered from the area of the second portion 114 adjacent to first portion 112 to the third outer edge 160; however, such taper does not have to be uniform in accordance with the present disclosure.

Accordingly, in this illustrated example embodiment, the load transfer plate 100 has its greatest width at the area where the first portion 112 and the second portion 114 meet or connect (i.e., along the center line or plane 116). Additionally, the first portion 112 and the second portion 114 are not symmetrical.

In this illustrated example embodiment, the load transfer plate 100 is also relatively wide compared to its thickness or height and has a length to width ratio of approximately 1:1; however, it should be appreciated that the width compared to the thickness or height may vary, and that the length to width ratio may vary in accordance with the present disclosure.

Figure 4A:
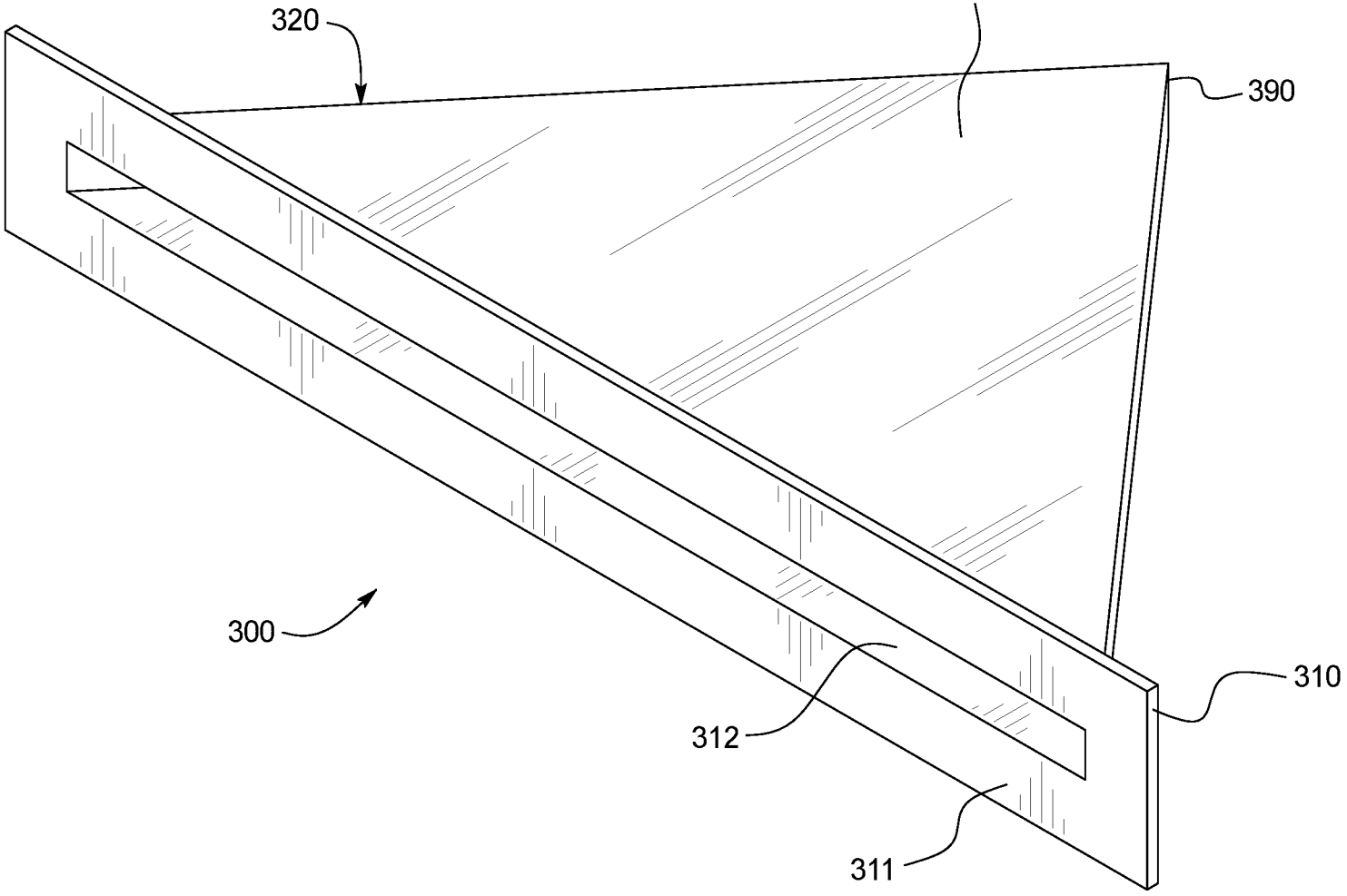
FIG. 4A is a top perspective view of a load transfer plate pocket used when installing the load transfer plate of FIG. 3.
Figure 4B:
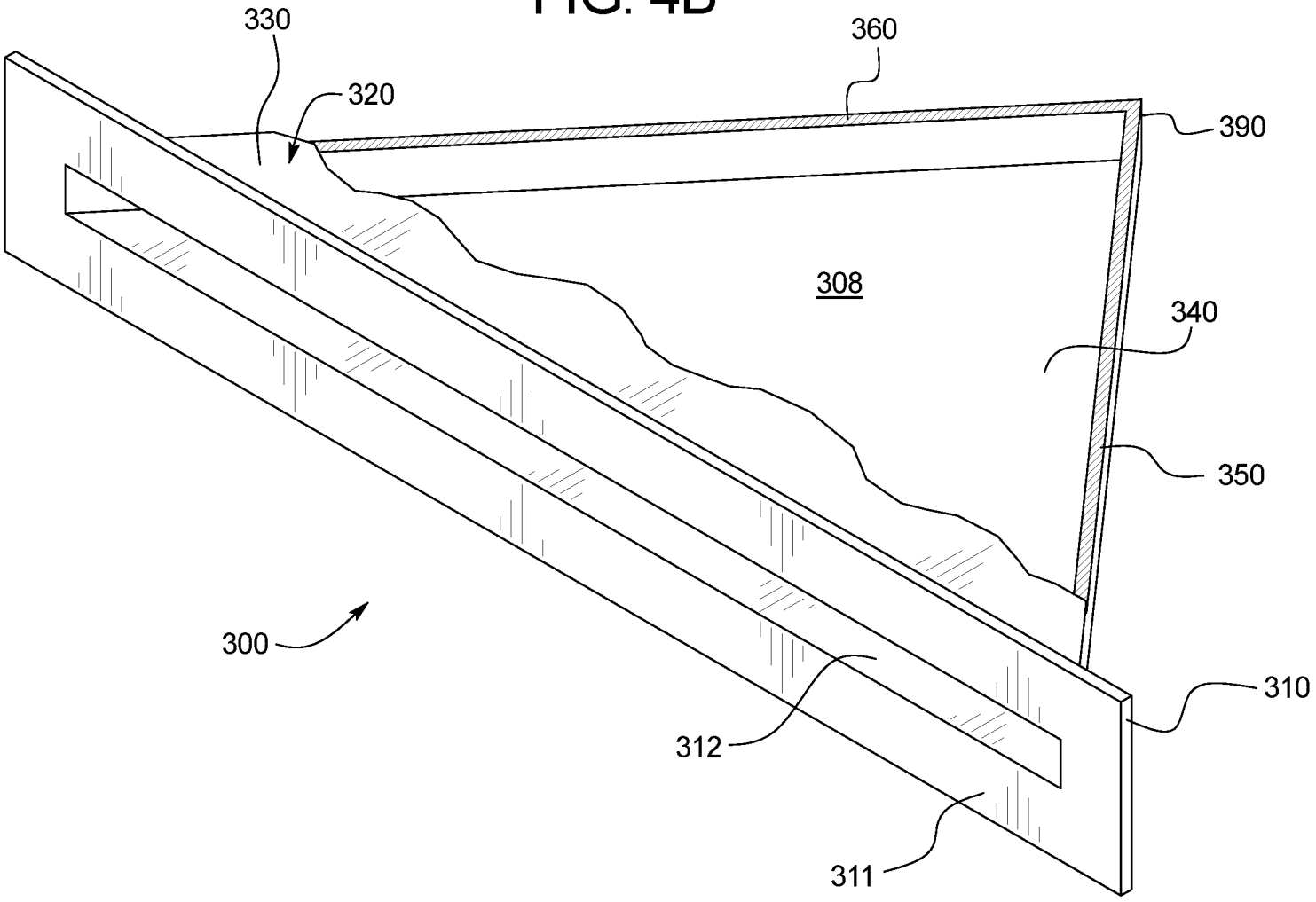
FIG. 4B is a fragmentary top perspective view of the load transfer plate pocket of FIG. 4A, showing interior portions of the load transfer plate pocket.

One example load transfer plate pocket 300 that can be used in installing the load transfer plate 100 in the new concrete slab 96 is shown in FIGS. 4A and 4B. This example load transfer plate pocket 300 includes a concrete side edge engager 310 and a generally triangular shaped body 320 integrally formed and extending from the back or back face of the concrete side edge engager 310. The body 320 of this illustrated example load transfer plate pocket 300 includes: (a) a triangular upper wall 330; (b) a triangular lower wall 340; (c) a first side wall 350; and (d) a second side wall 360.

More specifically, the concrete side edge engager 310 in this illustrated example embodiment includes a generally flat rectangular body 311 that defines a load transfer plate receiving opening or slot 312. The load transfer plate receiving opening or slot 312 is configured such that the load transfer plate 100 can move freely through the load transfer plate receiving opening or slot 312 when installing the load transfer plate pocket 300 on the load transfer plate 100.

The triangular upper wall 330 is integrally formed with and extends from the back or back face of the body 311 of the concrete side edge engager 310 above the load transfer plate receiving opening or slot 312. The triangular lower wall 340 is integrally formed with and extends from the back or back face of the body 311 of the concrete side edge engager 310 below the load transfer plate receiving opening or slot 312. The triangular lower wall 340 is thus spaced apart from the triangular upper wall 330 such that the load transfer plate 100 can move freely between the lower wall 340 and the upper wall 330 when vertical loads are placed on the load transfer plate 100.

The first side wall 350 is integrally formed with and extends from the back or back face of the body 311 of the concrete side edge engager 310 adjacent to one side of the load transfer plate receiving opening or slot 312. The first side wall 350 is also integrally connected to the triangular upper wall 330. The first side wall 350 is also integrally connected to the triangular lower wall 330.

The second side wall 360 is integrally formed with and extends from the back or back face of the body 311 of the concrete side edge engager 310 adjacent to one side of the load transfer plate receiving opening or slot 312. The second side wall 360 is also integrally connected to the triangular upper wall 330. The second side wall 360 is also integrally connected to the triangular lower wall 330. The second side wall 360 is integrally formed with and extends the first side wall 350.

The concrete side edge engager 310, the triangular upper wall 330, the triangular lower wall 340, the first side wall 350, and the second side wall 360 define a load transfer plate receiving chamber or area 308 that in this illustrated example embodiment is configured to receive the entire second half or portion 114 of the load transfer plate 100 as generally shown in FIGS. 4A and 4B.

As indicated or mentioned above, the present disclosure further provides a method of installing the load transfer plate 100 of the present disclosure with using the known load transfer plate pocket 300 for transferring loads between the existing cast-in-place concrete slab 90 and the new cast-in-place concrete slab 96. In various embodiments, the method generally includes the steps of: (1) making a cutaway 70 in the side edge 92 of the existing concrete slab 90 by using the cutting tool 10; (2) inserting the first portion 112 of the load transfer plate 100 into the cutaway 70 of the side edge 92 of the existing concrete slab 90; (3) inserting the second portion 114 of the load transfer plate 100 through the load transfer plate receiving opening 312 and into the load transfer plate receiving chamber 308 of the load transfer plate pocket 300 such that the load transfer plate pocket 300 and the load transfer plate 100 protrude into the area to be occupied by the new concrete slab 96; (4) pouring the concrete material that forms the new cast-in-place concrete slab 96 into the area to be occupied by the new concrete slab 96; and (5) allowing the new concrete slab 96 to cure or harden.

Figure 5:
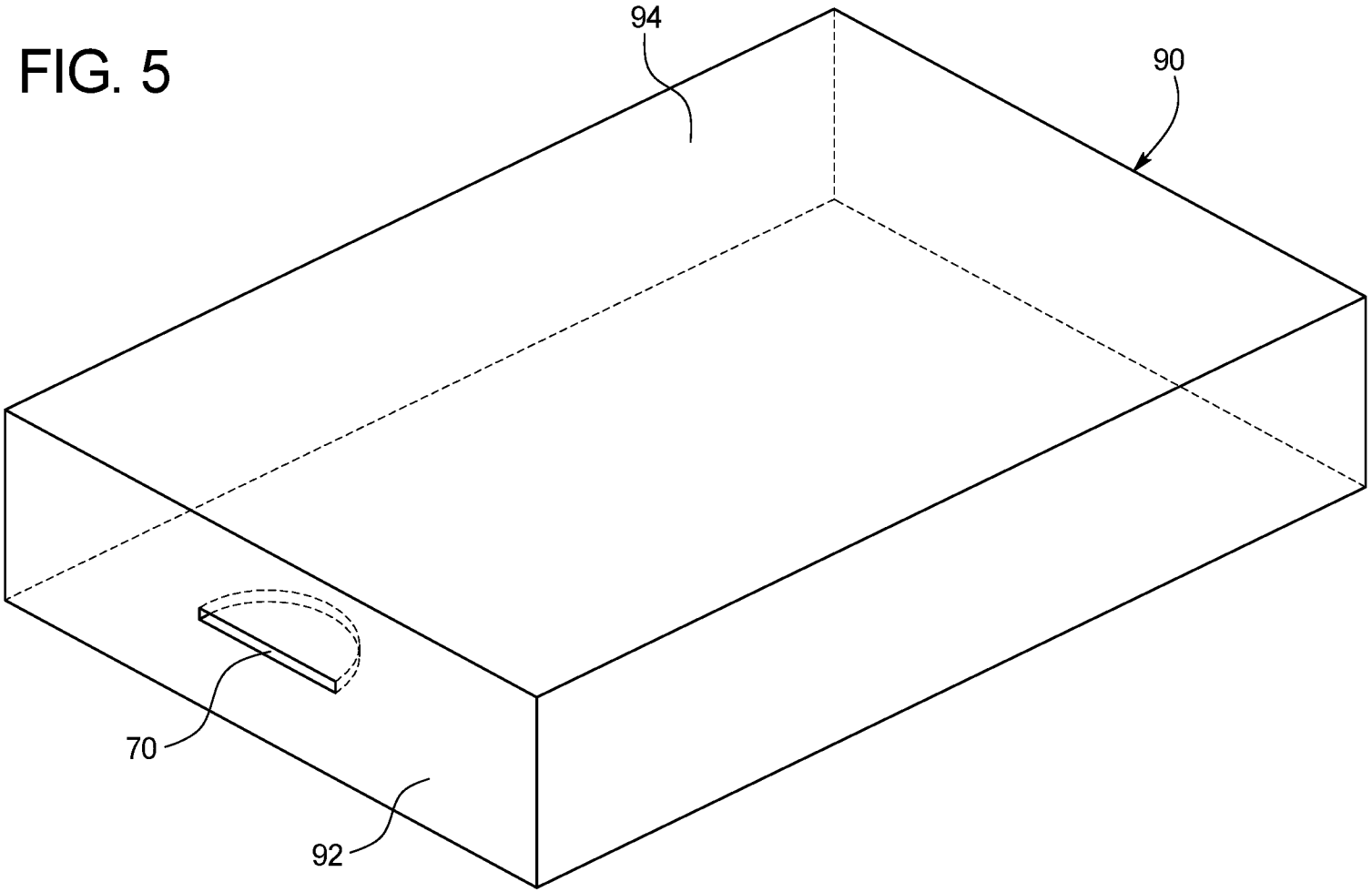
FIG. 5 is a top perspective view of an existing cast-in-place concrete slab and the cutaway made by the cutting tool of FIG. 1 in the side edge of the existing cast-in-place concrete slab.

More specifically, the area that is generally occupied by the new concrete slab 96 is vacant. In other words, (a) the new concrete slab 96 has not yet been poured in the area next to the existing concrete slab 90; or (b) an old concrete slab has been removed and is to be replaced later by a newly poured concrete slab, such as the new concrete slab 96. The cutting tool 10 is used to cut the cutaway 70 into the side edge 92 of the existing concrete slab 90 by positioning the cutting tool 10 on an upper surface 94 of the first concrete slab 90, as illustrated in FIGS. 1 and 5. The shape of the cutaway 70 is semi-cylindrical due to the circular saw blade used to cut the cutaway 70. The upper and lower surfaces of the cutaway 70 are generally parallel to the upper surface 94 of the existing concrete slab 90.

Figure 6:
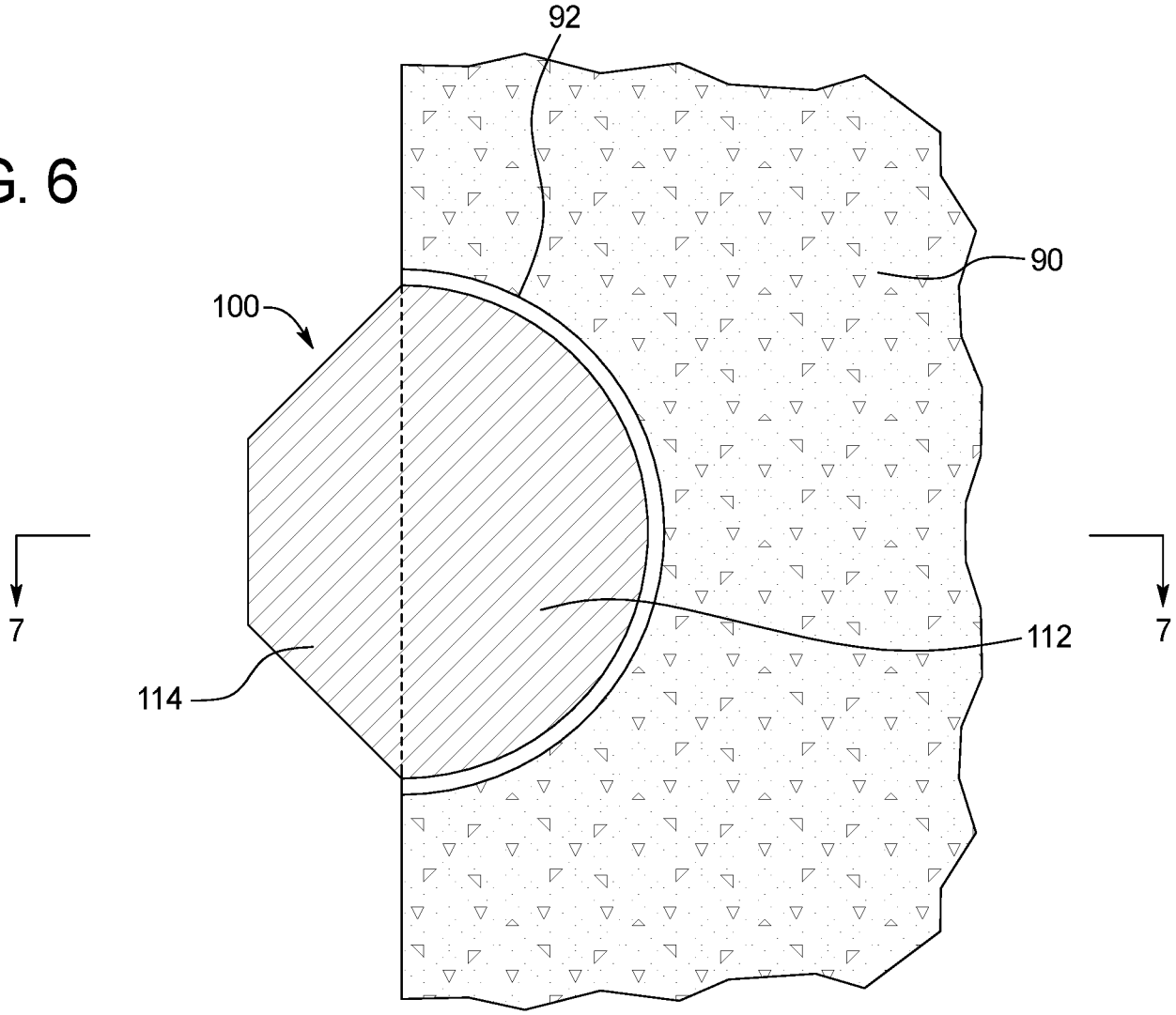
FIGS. 6 and 7 are a top cross-sectional view and a side cross-sectional view of a first portion of the load transfer plate of FIG. 3 positioned in the cutaway made in the side of edge of the existing concrete slab during installation and a second portion of the load transfer plate of FIG. 3 extending outwards in an area to be occupied by the new concrete slab.
Figure 7:
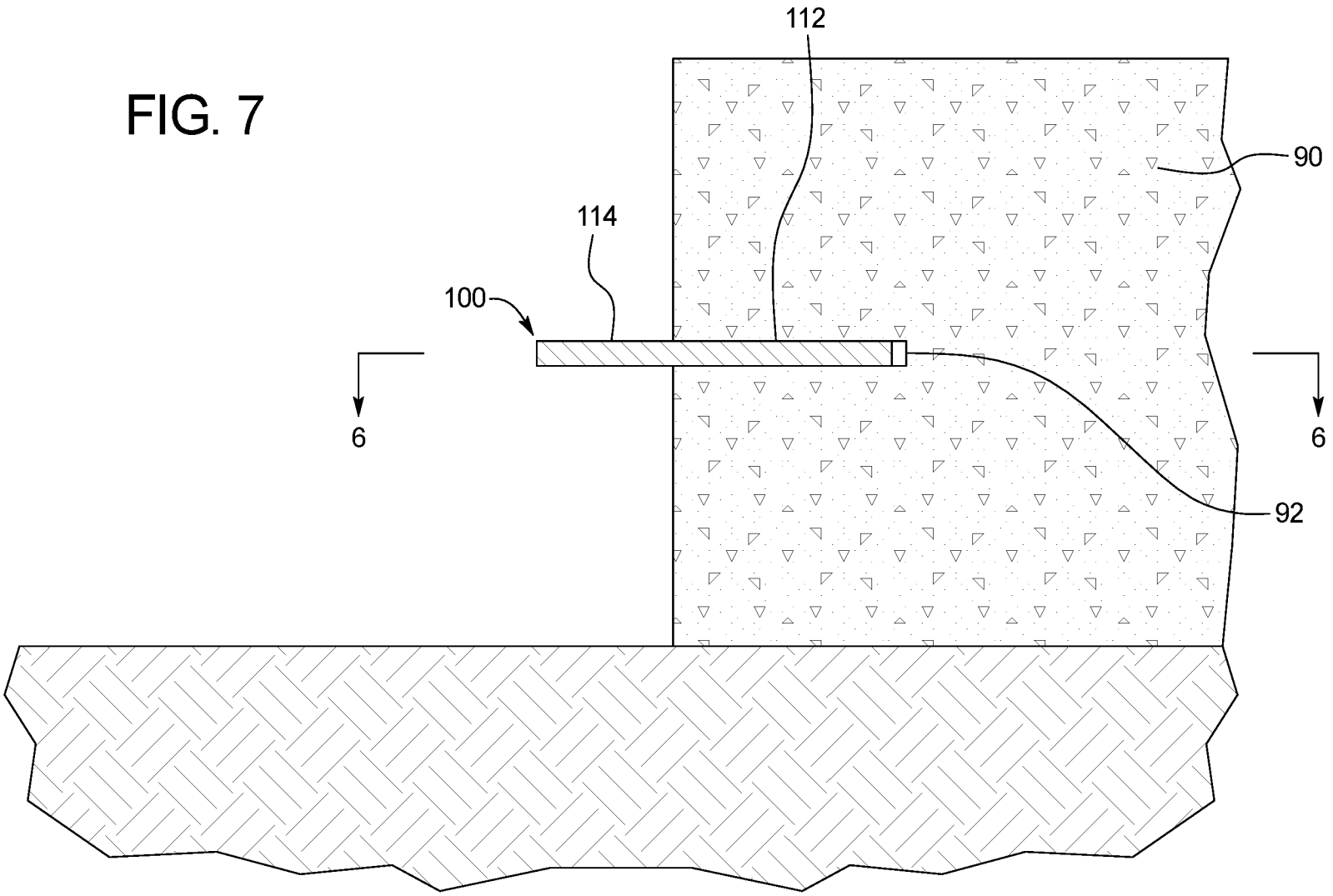
Figure 8:
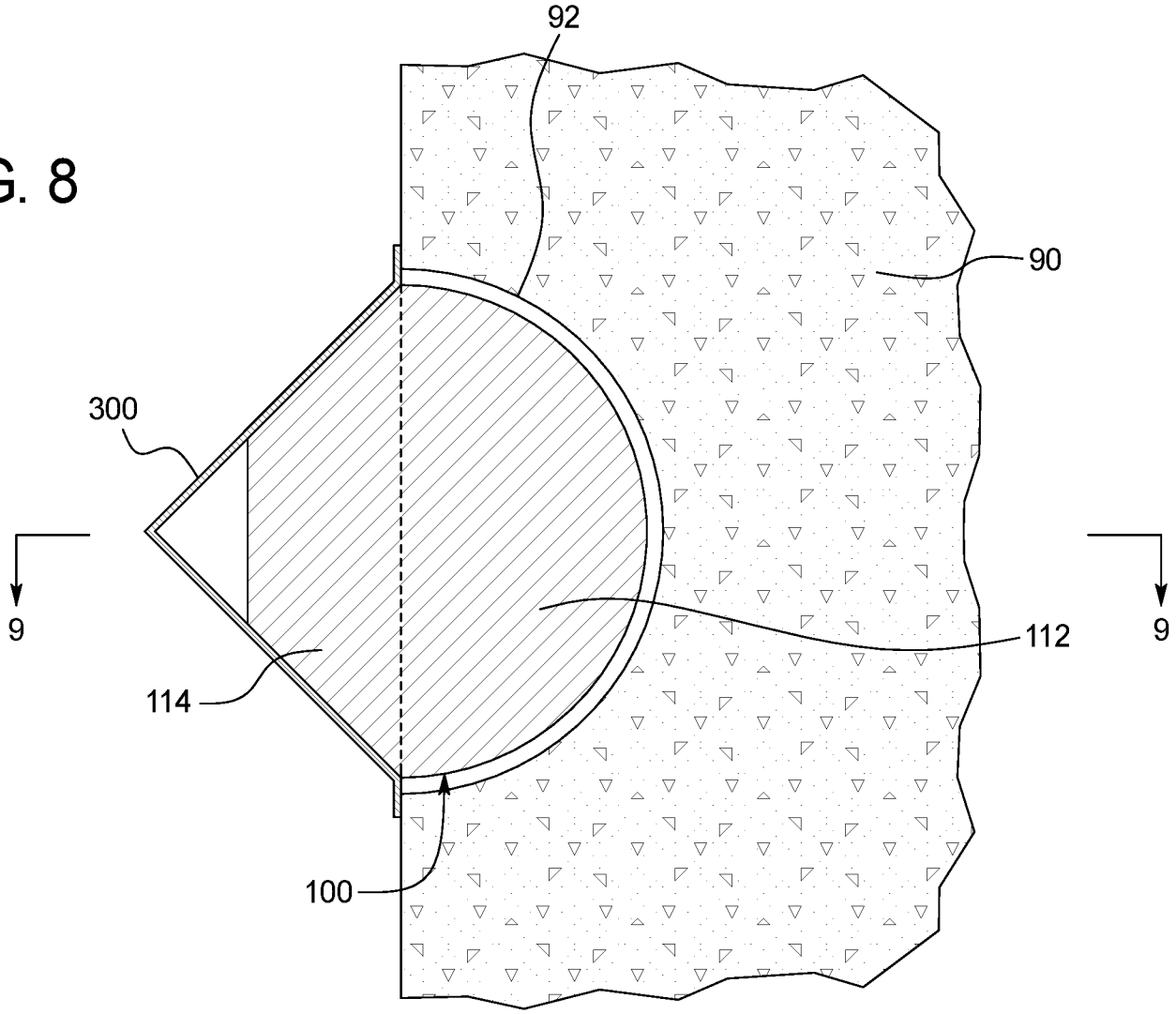
FIGS. 8 and 9 are a top cross-sectional view and a side cross-sectional view of the first portion of the load transfer plate of FIG. 3 positioned in the cutaway made in the side of edge of the existing concrete slab during installation and the second portion of the load transfer plate of FIG. 3 encapsulated by the load transfer plate pocket before the concrete material is poured to make the new concrete slab.
Figure 9:
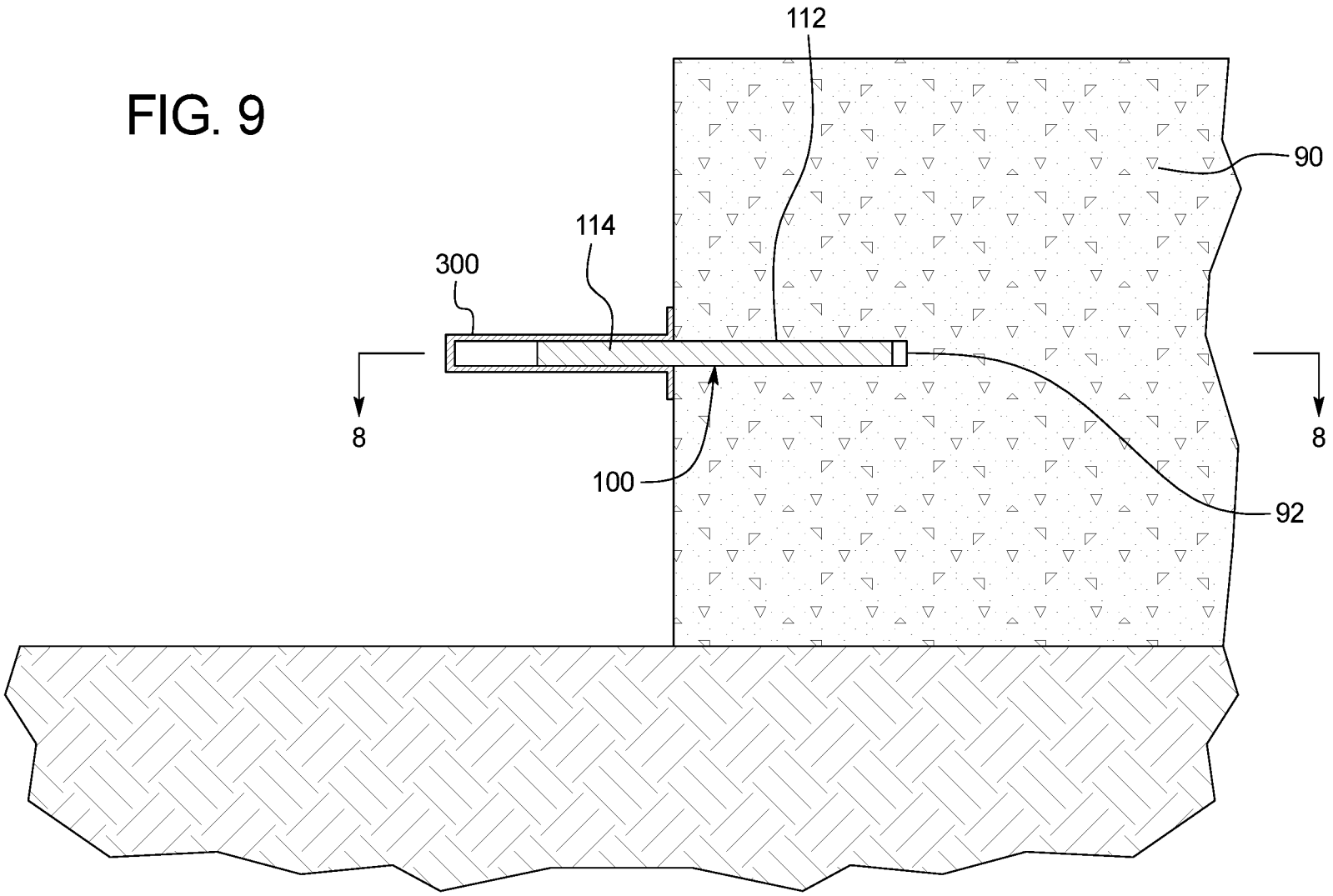

After making the cutaway 70 into the side edge 92 of the existing concrete slab 90, the method of certain embodiments of the present disclosure includes using epoxy to secure the load transfer plate 100 in the cutaway 70. In certain embodiments, epoxy is applied to one or more outer edges of the load transfer plate 100 that engage the one or more inner surfaces of the cutaway 70. In other embodiments, epoxy is applied to the one or more inner surfaces of the cutaway 70 prior to inserting the load transfer plate 100 into the cutaway 70. The method further includes positioning the first half or portion 112 of the load transfer plate 100 in the cutaway 70 of the first slab, as illustrated in FIGS. 6 and 7. The epoxy generally causes the first half or portion 112 of the load transfer plate 100 to not move relative to the cutaway 70 of the existing slab 90 when the central line between the two concrete slabs 90 and 96 moves and/or when vertical loads are placed on the load transfer plate 100 The method further includes installing the load transfer plate pocket 300 onto the load transfer plate 100 by inserting the second half or portion 114 of the load transfer plate 100 into the load transfer plate receiving opening 312 and further into the load transfer plate receiving chamber 308 of the load transfer plate pocket 300 such that the concrete side engager 310 of the load transfer plate pocket 300 engages the side edge 92 of the existing concrete slab 90, as illustrated in FIGS. 8 and 9. A gap may exists between the upper surface 120 of the load transfer plate 100 and the upper wall 330 of the load transfer plate pocket 300 or between the lower surface 130 of the load transfer plate 100 and the lower wall 340 of the load transfer plate pocket 300 so that the load transfer plate 100 can move freely between the lower wall 340 and the upper wall 330 when vertical loads are placed on the load transfer plate 100.

Figure 10:
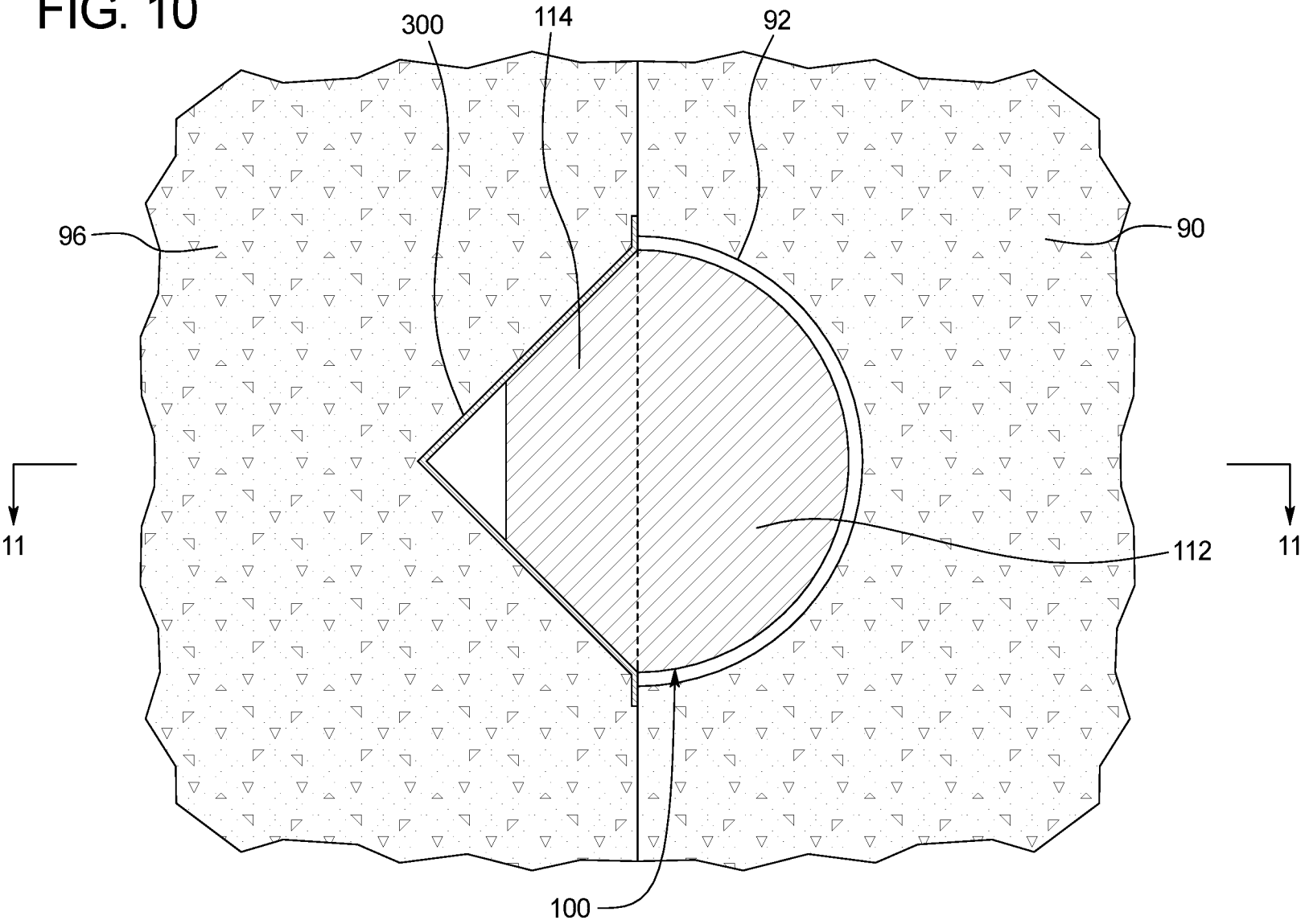
FIGS. 10 and 11 are a top cross-sectional view and a side cross-sectional view of the first portion of the load transfer plate of FIG. 3 positioned in the cutaway made in the side of edge of the existing concrete slab during installation and the second portion of the load transfer plate of FIG. 3 encapsulated by the load transfer plate positioned in the new concrete slab after the concrete material is poured to make the new concrete slab.
Figure 11:
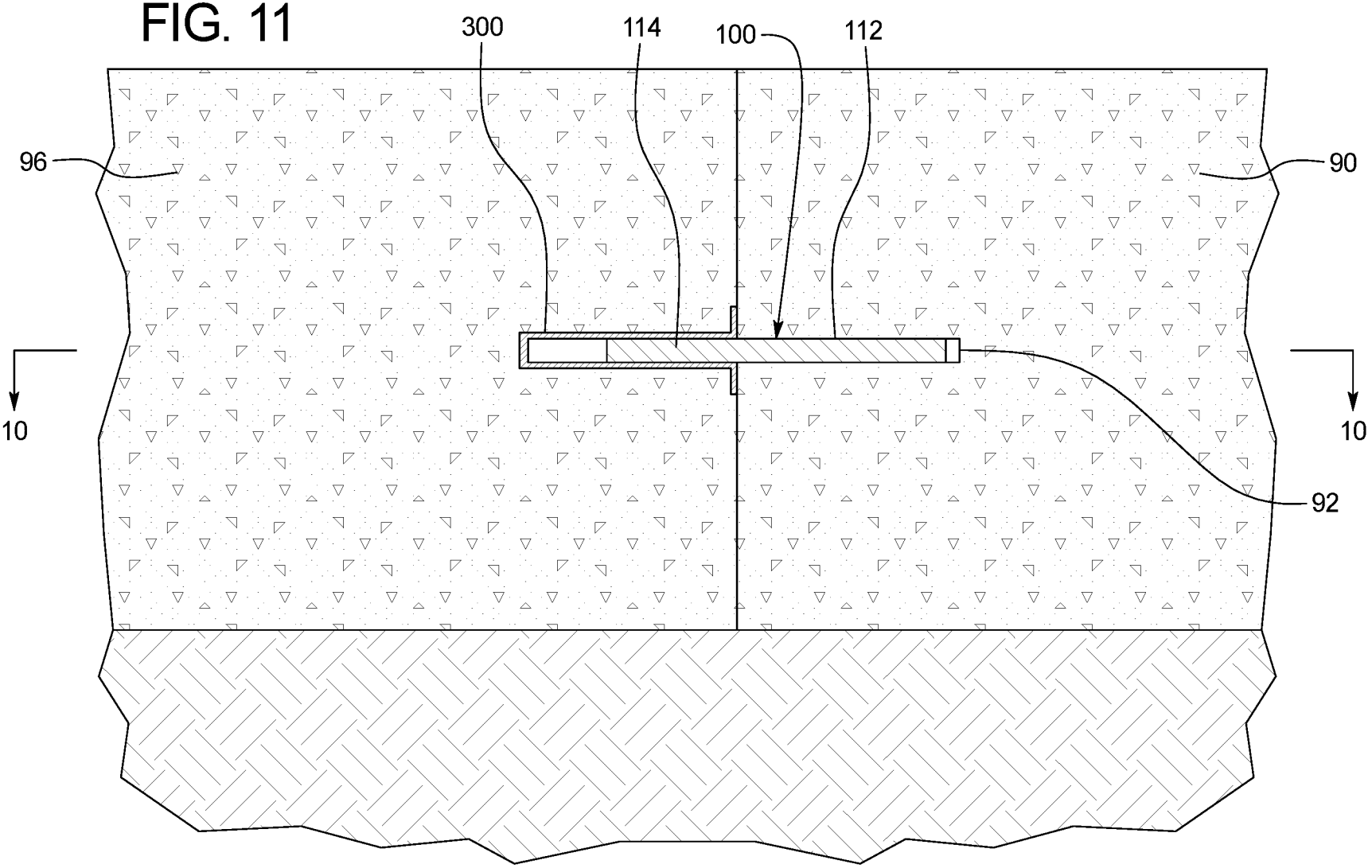

After positioning the load transfer plate pocket 300 onto the load transfer plate 100, the method further includes pouring the concrete material that forms the new cast-in-place concrete slab 96 into the area to be occupied by the new concrete slab 96, as illustrated in FIGS. 10 and 11. By doing so, the second half or portion 114 of the load transfer plate 100 protruding in the load transfer plate pocket 300 extends into the new concrete slab 96 and is maintained in the new concrete lab 96 after the new concrete slab 96 is poured and hardened or cured.

It should be appreciated that in an alternative method of the present disclosure, if slab 96 is the existing concrete slab and slab 90 is the new concrete slab, then the cutaway 70 is made in the side edge of slab 96, which is configured to partially receive a portion of the load transfer plate 100. The load transfer plate pocket 300 partially receives another portion of the load transfer plate 100 that is not extending into the cutaway 70. Concrete material that forms the existing cast-in-place concrete slab 90 is poured into the area to be occupied by the existing concrete slab 90 such that the load transfer plate pocket 300 partially receiving a portion of the load transfer plate 100 extends into the first concrete slab 90 and is maintained in the first concrete slab 90 after the first concrete slab 90 is poured and hardened or cured.

Figure 12A:
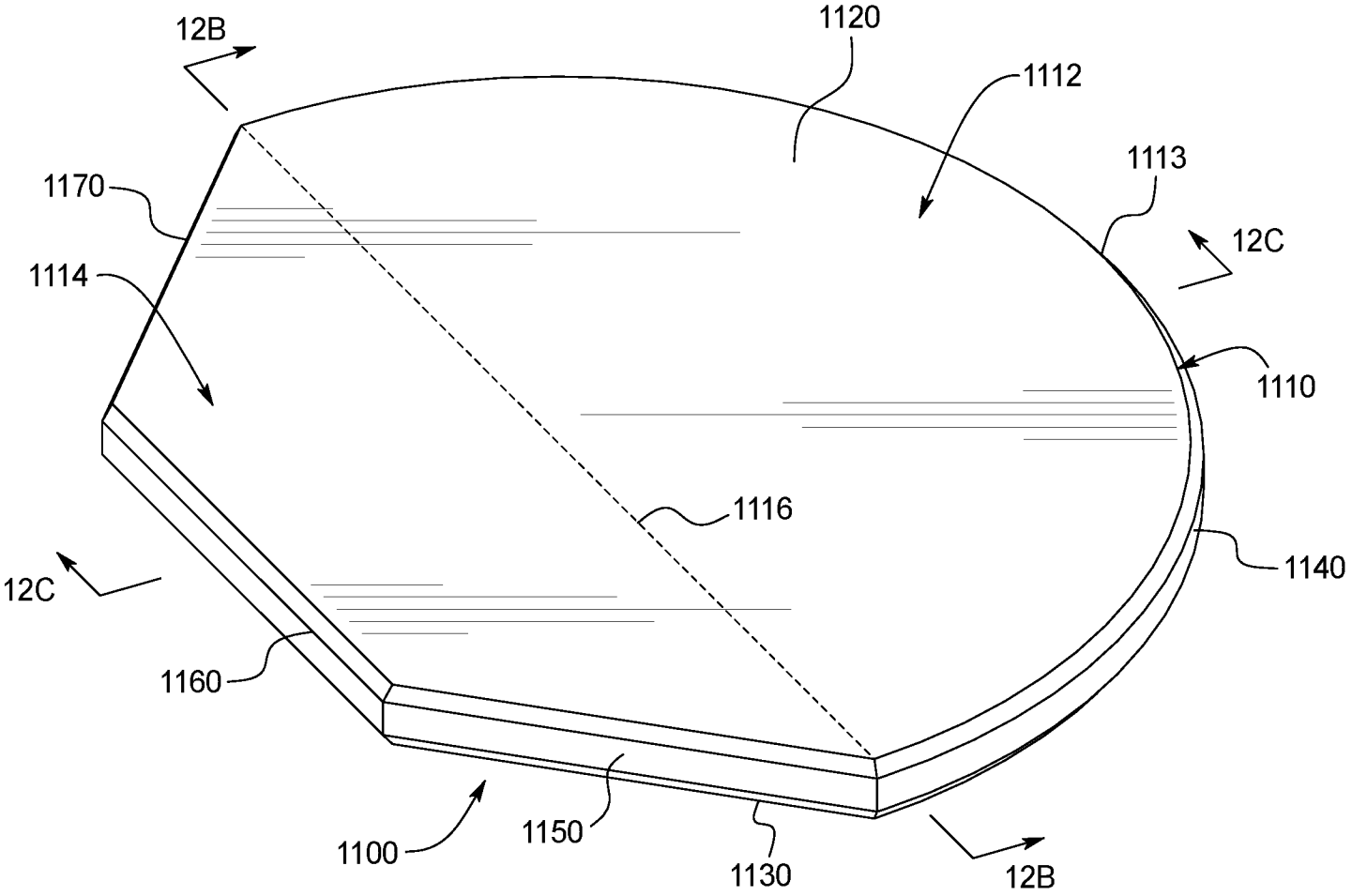
FIG. 12A is a top perspective view of an alternative example embodiment of the load transfer plate of the present disclosure.
Figure 12B:
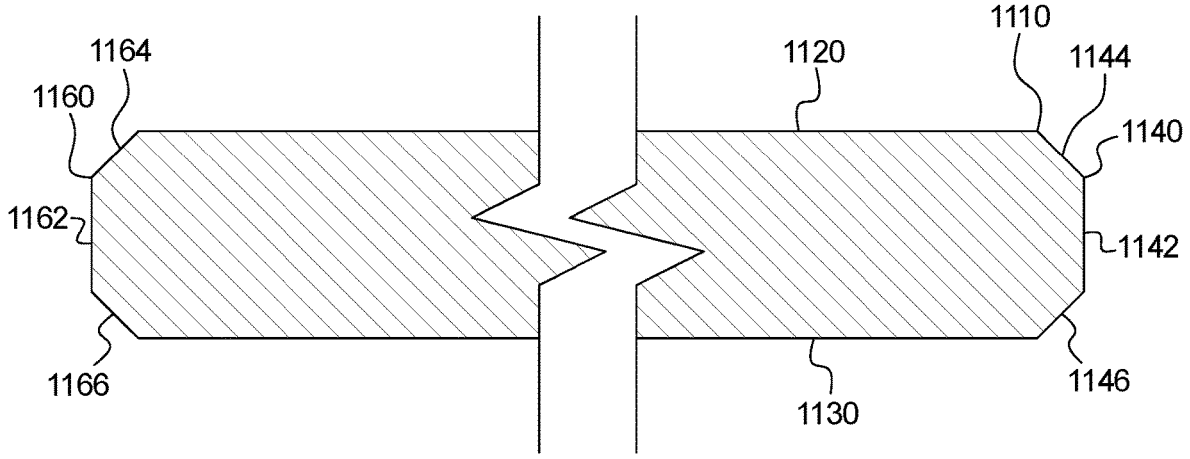
FIG. 12B is an enlarged cross-sectional view of the load transfer plate of FIG. 12A taken substantially along line 12B-12B of FIG. 12A.
Figure 12C:
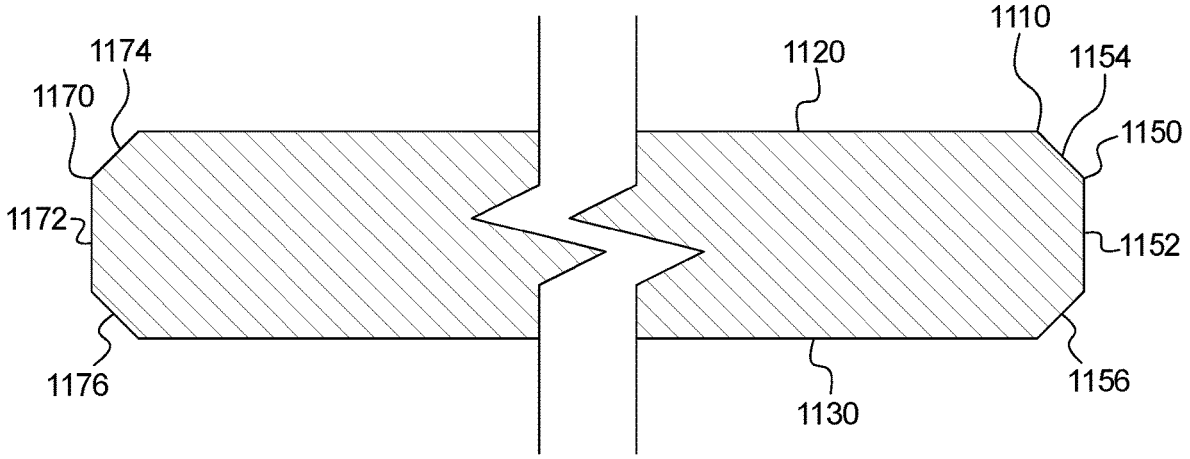
FIG. 12C is an enlarged cross-sectional view of the load transfer plate of FIG. 12A taken substantially along line 12C-12C of FIG. 12A.

Referring now to FIGS. 12A, 12B, and 12C, another example embodiment of the load transfer plate of the present disclosure is generally indicated by numeral 1100. This example embodiment is different in that the load transfer plate 1100 includes three part, multiple angled, or chamfered outer edges instead of straight outer edges.

In this illustrated example embodiment, the load transfer plate 1100 includes a generally non-symmetrically shaped body 1110 having: (a) a tapered, generally semi-cylindrical first half or portion 1112 configured to protrude into the cutaway 70 made in the straight edge of the existing concrete slab 90; and (b) a tapered, generally trapezoidal second half or portion 1114 configured to be partially positioned in the load transfer plate pocket 300 at installation and also protrude into and be secured in the new concrete slab 96.

The body 1110 of the load transfer plate 1100 also generally includes: (a) a substantially planar upper surface 1120; (b) a substantially planar lower surface 1130; (c) a first outer edge 1140; (d) a second outer edge 1150; (e) a third outer edge 1160; and (f) a fourth outer edge 1170.

The first outer edge 1140 is generally semi-cylindrical and includes: (a) a generally semi-cylindrical side edge 1142 that extends perpendicular to the upper surface 1120 and to the lower surface 1130; (b) a generally semi-cylindrical top angled edge 1144 that extends downwardly at an obtuse angle from the upper surface 1120 to the side edge 1142, and that extends upwardly at an obtuse angle from the side edge 1142 to the upper surface 1120; and (c) a generally semi-cylindrical bottom angled edge 1146 that extends upwardly at an obtuse angle from the lower surface 1130 to the side edge 1142, and that extends downwardly at an obtuse angle from the side edge 1142 to the lower surface 1130.

The second outer edge 1150 includes: (a) a side edge 1152 that extends perpendicular to the upper surface 1120 and to the lower surface 1130; (b) a top angled edge 1154 that extends downwardly at an obtuse angle from the upper surface 1120 to the side edge 1152, and that extends upwardly at an obtuse angle from the side edge 1152 to the upper surface 1120; and (c) a bottom angled edge 1156 that extends upwardly at an obtuse angle from the lower surface 1130 to the side edge 1152, and that extends downwardly at an obtuse angle from the side edge 1152 to the lower surface 1130.

The third outer edge 1160 includes: (a) a side edge 1162 that extends perpendicular to the upper surface 1120 and to the lower surface 1130; (b) a top angled edge 1164 that extends downwardly at an obtuse angle from the upper surface 1120 to the side edge 1162, and that extends upwardly at an obtuse angle from the side edge 1162 to the upper surface 1120; and (c) a bottom angled edge 1166 that extends upwardly at an obtuse angle from the lower surface 1130 to the side edge 1162, and that extends downwardly at an obtuse angle from the side edge 1162 to the lower surface 1130.

The fourth outer edge 1170 includes: (a) a side edge 1172 that extends perpendicular to the upper surface 1120 and to the lower surface 1130; (b) a top angled edge 1174 that extends downwardly at an obtuse angle from the upper surface 1120 to the side edge 1172, and that extends upwardly at an obtuse angle from the side edge 1172 to the upper surface 1120; and (c) a bottom angled edge 1176 that extends upwardly at an obtuse angle from the lower surface 1130 to the side edge 1172, and that extends downwardly at an obtuse angle from the side edge 1172 to the lower surface 1130.

In this illustrated example embodiment, the three part, multiple angled, or chamfered outer edges 1140, 1150, 1160, and 1170 reduce the concentrated stresses that the outer edges of the load transfer plate 1100 place on the portions of the concrete slab when which vertical loads are placed on the load transfer plate 1100. More specifically, these three part multiple angled or chamfered outer edges 1140, 1150, 1160, and 1170 spread the forces from a single line along the concrete slab to a wider area to reduce the concentrated stresses that the outer edges of the load transfer plate 1100 place on the portions of the concrete slab when vertical loads are placed on the load transfer plate 1100. These three part multiple angled or chamfered outer edges 1140, 1150, 1160, and 1170 additionally increase the amount of vertical load that can be placed on the load transfer plate 1100 before the load transfer plate 1100 causes a crack in the concrete slab.

In this illustrated example embodiment, the tapered first portion 1112 has a largest width (measured parallel to the longitudinal axis of the joint) at the area of the first portion 1112 adjacent to tapered second portion 1114, and a narrower width adjacent to the first outer edge 1140. In this illustrated example embodiment, the first portion 1112 is uniformly tapered from the area of the first portion 1112 adjacent to the second portion 1114 to the point 1113; however, such taper does not have to be uniform in accordance with the present disclosure.

In this illustrated example embodiment, the tapered second portion 1114 has a largest width (measured parallel to the longitudinal axis of the joint) at the area of the second portion 1114 adjacent to the tapered first portion 1112, and a narrower width adjacent to the third outer edge. In this illustrated example embodiment, the second portion 1114 is uniformly tapered from the area of the second portion 1114 adjacent to first portion 1112 to the third outer edge 1160; however, such taper does not have to be uniform in accordance with the present disclosure.

Accordingly, in this illustrated example embodiment, the load transfer plate 1100 has its greatest width at the area where the tapered first portion 1112 and the tapered second portion 1114 meet or connect (i.e., along the center line or plane 1116). In this illustrated example embodiment, the load transfer plate 1100 is also relatively wide compared to its thickness or height and has a length to width ratio of approximately 1:1; however, it should be appreciated that the width compared to the thickness or height may vary, and that the length to width ratio may vary in accordance with the present disclosure.

Figure 13:
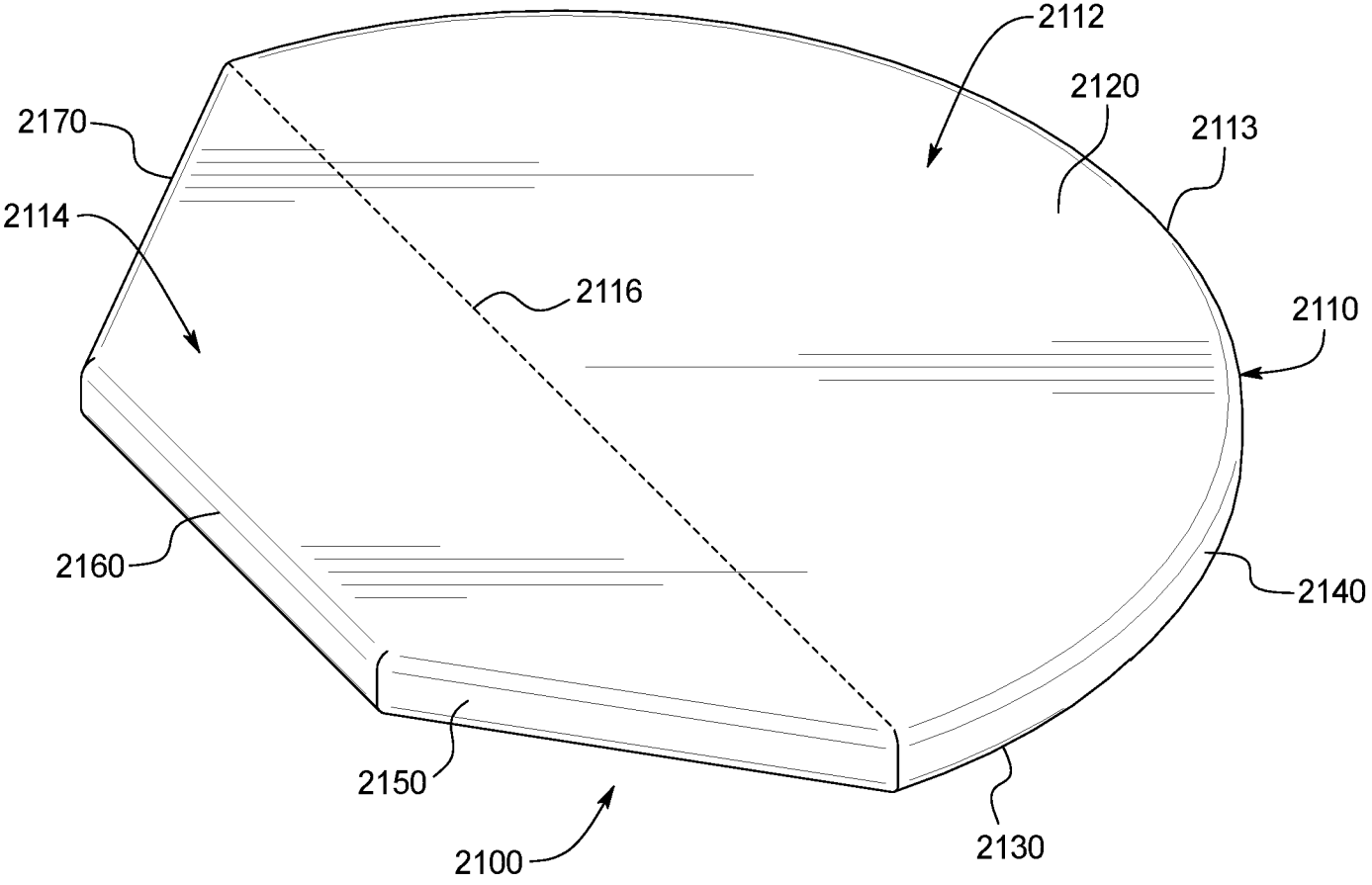
FIG. 13 is a top perspective view of a further alternative example embodiment of the load transfer plate of the present disclosure.

Referring now to FIG. 13, another example embodiment of the load transfer plate of the present disclosure is generally indicated by numeral 2100. This example embodiment is different in that the load transfer plate 2100 includes somewhat semi-cylindrical, rounded, or curved sides instead of three part, multiple angled, or chamfered outer edges or straight outer edges.

In this illustrated example embodiment, the load transfer plate 2100 includes a generally non-symmetrically shaped body 2110 having: (a) a tapered, generally semi-cylindrical first half or portion 2112 configured to protrude into the cutaway 70 made in the straight edge of the existing concrete slab 90; and (b) a tapered, generally trapezoidal second half or portion 2114 configured to be partially positioned in the load transfer plate pocket 300 at installation and also protrude into and be secured in the new concrete slab 96.

The body 2110 of the load transfer plate 2100 also generally includes: (a) a substantially planar upper surface 2120; (b) a substantially planar lower surface 2130; (c) a first generally semi-cylindrical outer edge 2140; (d) a second outer edge 2150; (e) a third outer edge 2160; and (f) a fourth outer edge 2170.

The first outer edge includes a somewhat semi-cylindrical, rounded, or curved side edge. The second outer edge 2150 includes a somewhat semi-cylindrical, rounded, or curved side. The third outer edge 2160 includes a somewhat semi-cylindrical, rounded, or curved side edge. The fourth outer edge 2170 includes a somewhat semi-cylindrical, rounded, or curved side edge.

In this illustrated example embodiment, the tapered first portion 2112 has a largest width (measured parallel to the longitudinal axis of the joint) at the area of the first portion 2112 adjacent to tapered second portion 2114, and a narrower width adjacent to the first outer edge 2140. In this illustrated example embodiment, the first portion 2112 is uniformly tapered from the area of the first portion 2112 adjacent to the second portion 2114 to the point 2113; however, such taper does not have to be uniform in accordance with the present disclosure.

In this illustrated example embodiment, the tapered second portion 2114 has a largest width (measured parallel to the longitudinal axis of the joint) at the area of the second portion 2114 adjacent to the tapered first portion 2112, and a narrower width adjacent to the third outer edge 2160. In this illustrated example embodiment, the second portion 2114 is uniformly tapered from the area of the second portion 2114 adjacent to the first portion 2112 to the third outer edge 2160; however, such taper does not have to be uniform in accordance with the present disclosure.

Accordingly, in this illustrated example embodiment, the load transfer plate 2100 has its greatest width at the area where the tapered first portion 2112 and the tapered second portion 2114 meet or connect (i.e., along the center line or plane 2116).

In this illustrated example embodiment, the load transfer plate 2100 is also relatively wide compared to its thickness or height and has a length to width ratio of approximately 1:1; however, it should be appreciated that the width compared to the thickness or height may vary, and that the length to width ratio may vary in accordance with the present disclosure.

Figure 14:
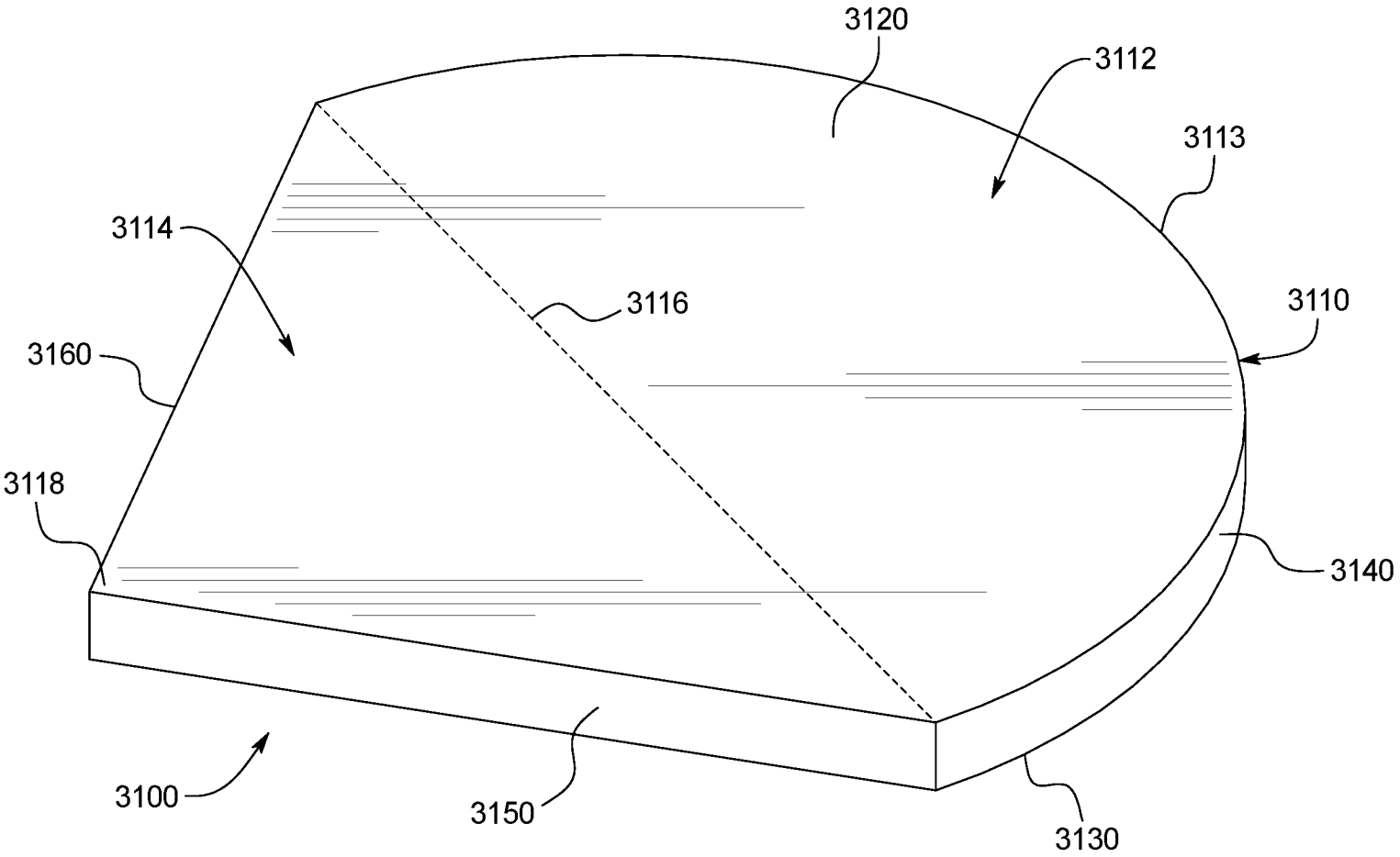
FIG. 14 is a top perspective view of a further alternative example embodiment of the load transfer plate of the present disclosure.

Referring now to FIG. 14, another example embodiment of the load transfer plate of the present disclosure is generally indicated by numeral 3100. This example embodiment is different in that the load transfer plate 3100 includes a generally triangular second half or portion instead of a generally trapezoidal second half or portion.

In this illustrated example embodiment, the load transfer plate 3100 includes a generally non-symmetrically shaped body 3110 having: (a) a tapered, generally semi-cylindrical first half or portion 3112 configured to protrude into the cutaway 70 made in the straight edge of the existing concrete slab 90; and (b) a tapered, generally triangular second half or portion 3114 configured to be partially positioned in the load transfer plate pocket 300 at installation and also protrude into and be secured in the new concrete slab 96.

The body 3110 of the load transfer plate 3100 also generally includes: (a) a substantially planar upper surface 3120; (b) a substantially planar lower surface 3130; (c) a first outer edge 3140; (d) a second outer edge 3150; and (e) a third outer edge 3160. The first outer edge 3140 extends perpendicular or substantially perpendicular to the upper surface 3120 and to the lower surface 3130 and is generally semi-cylindrical. The second outer edge 3150 extends perpendicular or substantially perpendicular to the upper surface 3120 and to the lower surface 3130 and is generally straight. The third outer edge 3160 extends perpendicular or substantially perpendicular to the upper surface 3120 and to the lower surface 3130 and is generally straight.

It should be appreciated that the outer edges 3140, 3150, and 3160 can include one or more angled side edges. It should further be appreciated that the outer edges 3140, 3150, and 3160 can include a somewhat semi-cylindrical, rounded, or curved side edge.

In this illustrated example embodiment, the tapered first portion 3112 has a largest width (measured parallel to the longitudinal axis of the joint) at the area of the first portion 3112 adjacent to the tapered second portion 3114, and a narrower width adjacent to the first outer edge 3140. In this illustrated example embodiment, the first portion 3112 is uniformly tapered from the area of the first portion 3112 adjacent the second portion 3114 to the point 3113; however, such taper does not have to be uniform in accordance with the present disclosure.

In this illustrated example embodiment, the tapered second portion 3114 has a largest width (measured parallel to the longitudinal axis of the joint) at the area of the second portion 3114 adjacent to tapered first portion 3112, and a narrower width at the point 3118. In this illustrated example embodiment, the second portion 3114 is uniformly tapered from the area of the second portion 3114 adjacent to first portion 3112 to the point 3118; however, such taper does not have to be uniform in accordance with the present disclosure.

Accordingly, in this illustrated example embodiment, the load transfer plate 1100 has its greatest width at the area where the tapered first portion 3112 and the tapered second portion 3114 meet or connect (i.e., along the center line or plane 3116).

In this illustrated example embodiment, the load transfer plate 3100 is also relatively wide compared to its thickness or height and has a length to width ratio of approximately 1:1; however, it should be appreciated that the width compared to the thickness or height may vary, and that the length to width ratio may vary in accordance with the present disclosure.

It should be appreciated that in an alternative method of the present disclosure, it is not necessary to use epoxy when installing the load transfer plate pocket of the present disclosure. This enables various embodiments of the load transfer plate of the present disclosure to move with respect to the cutaway 70 when vertical loads are placed on the load transfer plate of the present disclosure.

It should further be appreciated that various load transfer plates of the present disclosure can be installed in the first concrete slab and the second concrete slab using a load transfer place pocket having a generally trapezoidal shaped body.

It should further be appreciated that suitable tape can be applied to where the load transfer plate pocket 300 engages the side edge 92 of the existing concrete slab 90 to prevent wet cement from pouring into the load transfer plate receiving opening 312.

It should further be appreciated that various embodiments of the load transfer plate of the present disclosure can include one or more interior edges that define one or more slab attachment openings. These slab attachment openings enable concrete of the second slab to extend through the load transfer plate when the load transfer plate is positioned in the load transfer plate pocket and concrete that forms the second slab is poured. This causes the load transfer plate to be secured or locked to the second concrete slab after this concrete slab cures or hardens. Thus, the load transfer plate moves with the shrinkage of the second concrete slab and also moves with any other subsequent movement of the second concrete slab.

It should further be appreciated that various embodiments of the load transfer plate of the present disclosure can include a generally non-symmetrically shaped body having: (a) a tapered first half or portion configured to protrude into the cutaway made in the straight edge of the existing concrete slab 90; and (b) a tapered second half or portion configured to be partially positioned in the load transfer plate pocket 300 at installation and also protrude into and be secured in the new concrete slab 96, wherein the first half or portion is configured to have a generally semi-cylindrical shape and the second half or portion is configured to have an alternative suitable shape that does not mirror the shape of the first half or portion.

It should further be appreciated that another suitable cutting tool can be used when installing the various example embodiments of the load transfer plate of the present disclosure in the existing concrete slab and the new concrete slab.

It should be appreciated from the above that in various embodiments the present disclosure provides a load transfer plate for transferring loads across a joint between a first or existing cast-in-place concrete slab and a second or new cast-in-place concrete slab, the load transfer plate comprising: a non-symmetrically shaped body having: (i) a first, generally semi-cylindrical portion configured to protrude into and be secured in the first cast-in-place concrete slab; (ii) a second, generally trapezoidal portion configured to protrude into a load transfer plate pocket secured in the second cast-in-place concrete; (iii) a substantially planar upper surface; and (iv) a substantially planar lower surface.

It should also be appreciated from the above that in various embodiments the present disclosure provides a load transfer plate for transferring loads across a joint between a first or existing cast-in-place concrete slab and a second or new cast-in-place concrete slab, the load transfer plate comprising: a non-symmetrically shaped body having: (i) a first, generally semi-cylindrical portion configured to protrude into and be secured in the first cast-in-place concrete slab; (ii) a second, generally triangular portion configured to protrude into a load transfer plate pocket secured in the second cast-in-place concrete; (iii) a substantially planar upper surface; and (iv) a substantially planar lower surface.

It should also be appreciated from the above that in various embodiments the present disclosure provides a load transfer plate for transferring loads across a joint between a first or existing cast-in-place concrete slab and a second or new cast-in-place concrete slab, the load transfer plate comprising: a non-symmetrically shaped body having: (a) a semi-cylindrical first portion configured to protrude into and be secured in the first cast-in-place concrete slab; (b) a non-semi cylindrical second portion configured to protrude into a load transfer plate pocket secured in the second cast-in-place concrete; (c) a substantially planar upper surface; and (d) a substantially planar lower surface.

In certain such embodiments of the load transfer plate, the second portion has a trapezoidal shape.

In certain such embodiments of the load transfer plate, the second portion has a triangular shape.

In certain such embodiments of the load transfer plate, the first portion has a semi-cylindrical shape and the second portion has a generally trapezoidal shape.

In certain such embodiments of the load transfer plate, the first portion has a semi-cylindrical shape and the second portion has a triangular shape.

It should also be appreciated from the above that in various embodiments the present disclosure provides a method for transferring loads across a joint between concrete first cast-in-place concrete slab and a second cast-in-place concrete slab, said method comprising: (a) cutting a cutaway in a side edge of the first cast-in-place concrete slab; (b) positioning a semi-cylindrical first portion of a load transfer plate into the cutaway of the side edge of the first cast-in-place concrete slab; (c) positioning a non-semi cylindrical second portion of the load transfer plate into a load transfer plate receiving opening and further into a load transfer plate receiving chamber of a load transfer plate pocket such that the load transfer plate pocket and the load transfer plate protrude into an area to be occupied by the second cast-in-place concrete slab; (d) pouring concrete material that forms the second cast-in-place concrete slab into the area to be occupied by the second cast-in-place concrete slab; and (e) allowing the second cast-in-place concrete slab to cure or harden.

It should be understood that various changes and modifications to the presently preferred example embodiments described herein will be apparent to those skilled in the art. Such change and modifications can be made without departing from the spirit and scope of the present subject matter and without diminishing its intended advantages. It is therefore intended that such changes and modifications be covered by the appended claims.

The invention is claimed as follows:

1. An apparatus for transferring loads across a joint between a first cast-in-place concrete slab and a second cast-in-place concrete slab, the apparatus comprising:

a load transfer plate including:

a body having:

(i) a first, generally semi-cylindrical portion configured to protrude into and be secured in the first cast-in-place concrete slab;

(ii) a second, generally trapezoidal portion having a shape that is non-symmetrical relative to a shape of the first portion, and does not mirror the shape of the first portion;

(iii) a substantially planar upper surface; and (iv) a substantially planar lower surface; and a load transfer plate pocket securable in the second cast-in-place concrete slab, the load transfer plate pocket configured to receive the second portion, wherein when the second portion is positioned in the load transfer plate pocket, the load transfer plate pocket and the second portion partially define a generally triangular gap adjacent to the second portion.

2. The apparatus of claim 1, wherein the first cast-in-place concrete slab is an existing cast-in-place concrete slab and the second cast-in-place concrete slab is a new cast-in-place concrete slab.

3. An apparatus for transferring loads across a joint between a first cast-in-place concrete slab and a second cast-in-place concrete slab, the apparatus comprising:

a load transfer plate pocket including:

a first inner wall that is a planar and extending in a first plane; and a second inner wall that is planar and extends in a second plane that intersects and is transverse to the first plane;

wherein the load transfer plate pocket is securable in the second cast-in-place concrete slab; and a load transfer plate including a body having:

(a) a semi-cylindrical first portion configured to protrude into and be secured in the first cast-in-place concrete slab;

(b) a non-semi cylindrical second portion configured to protrude into the load transfer plate pocket secured in the second cast-in-place concrete slab, wherein the second portion is connected to the first portion along a center plane, and wherein the second portion includes an outer wall having:

a first wall configured to contact the first inner wall of the load transfer plate pocket;

a second wall configured to contact the second inner wall of the load transfer plate pocket, wherein the second wall is spaced apart from the first wall; and a third wall connecting the first wall and the second wall;

(c) a substantially planar upper surface; and (d) a substantially planar lower surface, wherein when the second portion is positioned in the load transfer plate pocket, the first inner wall of the load transfer plate pocket, the second inner wall of the load transfer plate pocket, and the third wall of the load transfer plate partially define a gap, and wherein the gap has a shape different from the second portion.

4. The apparatus of claim 3, wherein the second portion has a trapezoidal shape.

5. The apparatus of claim 3, wherein the second portion has a generally trapezoidal shape.

6. The apparatus of claim 3, wherein the first cast-in-place concrete slab is an existing cast-in-place concrete slab and the second cast-in-place concrete slab is a new cast-in-place concrete slab.

* * * * *